US009868201B2

(12) United States Patent
Kamiya

(10) Patent No.: US 9,868,201 B2
(45) Date of Patent: Jan. 16, 2018

(54) AUXILIARY HANDLE AND POWER TOOL HAVING THE SAME

(71) Applicant: MAKITA CORPORATION, Anjo-shi, Aichi (JP)

(72) Inventor: Takeshi Kamiya, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 458 days.

(21) Appl. No.: 14/581,316

(22) Filed: Dec. 23, 2014

(65) Prior Publication Data

US 2015/0174753 A1 Jun. 25, 2015

(30) Foreign Application Priority Data

Dec. 25, 2013 (JP) ..... 2013-268138

(51) Int. Cl.
*B25F 5/02* (2006.01)
*B25F 5/00* (2006.01)

(52) U.S. Cl.
CPC ..... *B25F 5/026* (2013.01); *B25F 5/008* (2013.01); *B25F 5/02* (2013.01); *Y10T 16/4713* (2015.01)

(58) Field of Classification Search
CPC ..... B25F 5/026; B23B 45/001; B23B 45/003
USPC ..... 173/170, 201, 176, 171; 16/426, 436
See application file for complete search history.

(56) References Cited

U.S. PATENT DOCUMENTS 4,276,675 A * 7/1981 Pioch ..... B23B 45/001 16/426
6,595,300 B2 * 7/2003 Milbourne ..... B25B 21/00 16/431
8,032,990 B2 * 10/2011 Shinma ..... B25D 17/04 16/426
2010/0064482 A1 * 3/2010 Martin ..... B25F 5/026 16/426
2010/0206596 A1 * 8/2010 Kamegai ..... B23D 51/01 173/162.2
2011/0120741 A1 5/2011 Limberg et al.

FOREIGN PATENT DOCUMENTS

JP 2002-337074 A 11/2002
JP 2004-261052 A 9/2004

OTHER PUBLICATIONS

Apr. 12, 2017 Office Action issued in Japanese Patent Application No. 2013-268138.

* cited by examiner

*Primary Examiner* — Nathaniel Chukwurah
(74) *Attorney, Agent, or Firm* — Oliff PLC

(57) ABSTRACT

An auxiliary handle (10) comprises a first clamp member (21), a second clamp member (31), an operation rod (40) and a grip (50). By rotation of the operation rod (40), the first clamp member (21) is moved toward a distal end of the operation rod (40), and at the same time, the second clamp member (31) is moved toward a base end of the operation rod (40). Accordingly, the first clamp member (21) and the second clamp member (31) are moved to be close to each other. As a result, an auxiliary handle attachable part (140) of a screw driver (100) is clamped by the first clamp member (21) and the second clamp member (31), and thereby the auxiliary handle (10) is attached to the screw driver (100).

16 Claims, 16 Drawing Sheets

AUXILIARY HANDLE AND POWER TOOL HAVING THE SAME

CROSS REFERENCE TO RELATED APPLICATION

The present application claims priority from Japanese Patent Applications No. 2013-268138 filed on Dec. 25, 2013, the entire contents of which are incorporated by reference herein.

FIELD OF THE INVENTION

The present invention relates to an auxiliary handle which is attached to a power tool and the power tool having the same.

BACKGROUND OF THE INVENTION

U.S. No. 2011/0120741 discloses an auxiliary handle which is attached to a power tool. The auxiliary handle comprises a first clamp member, a second clamp member, a rod and a grip. The auxiliary handle is attached to the power tool by clamping a gear housing of the power tool by the first and the second clamp members.

SUMMARY OF THE INVENTION

In the auxiliary handle described above, the first clamp member is fixed on a tip end of the rod. Accordingly, by moving the second clamp member toward the first clamp member fixed on the tip end of the rod, the gear housing of the power tool is clamped by the first and second clamp members. However, as the first clamp member is fixed on the rod, an attaching operation of the auxiliary handle to the power tool requires much time. In this respect, to improve an attaching operation of the auxiliary handle to the power tool is desired.

Accordingly, an object of the present disclosure is, in consideration of the above described problem, to provide an improved technique for attaching an auxiliary handle to a power tool.

Above-mentioned problem is solved by the present invention. According to a preferable aspect of the present disclosure, an auxiliary handle which is detachably attached to a main body of a power tool having a main handle is provided. The auxiliary handle comprises a grip portion, a first clamp member, a second clamp member and an operation member. The grip portion is configured to be held by a user. The first clamp member has a first clamp part. The second clamp member has a second clamp part. Further, the operation member is configured to be operated by a user and move the first clamp member and the second clamp member. In this disclosure, one operation member is provided for operating the clamp members, that is, the operation member preferably includes a first aspect in which it is formed by a plurality of members connected integrally to each other and a second aspect in which it is singularly formed as one piece. Therefore, the clamp members are operated by only one, singular operation member. The operation member may be configured to be directly and manually operated by a user, on the other hand, the operation member may be configured to be indirectly operated by a user via an intervening member. The first clamp member and the second clamp member are respectively moved at the same time to be close to each other by attaching operation of the operation member operated by a user. Thereby, the first clamp part and the second clamp part clamp the main body of the power tool, and the auxiliary handle is attached to the main body by the first clamp member and the second clamp member. That is, by cooperation of the first clamp part and the second clamp part, the main body of the power tool is clamped. As to clamp members of the auxiliary handle, at least two clamp members are necessary to clamp the main body, that is, more than three clamp members to clamp the main body may be provided in the auxiliary handle. In such a case, more than three clamp members are simultaneously moved by operation of the singular operation member, and thereby the main body is clamped by said re than three clamp members. Further, when the auxiliary handle is detached from the main body of the power tool, the first clamp member and the second clamp member are respectively moved away from each other by detaching operation of the operation member operated by a user. Thereby, clamping of the main body of the power tool by the first clamp member and the second clamp member is released.

According to this aspect, operation of a user to the singular operation member causes the first clamp member and the second clamp member to move to be close to each other. Therefore, compared to a construction in which only one of clamp members moves toward the other clamp member by an operation member, changing rate of a distance between the clamp members becomes larger. That is, in this disclosure, relative movement between the first clamp member and the second clamp member per unit operation amount of a user with respect to the operation member becomes larger. The unit operation amount may be defined, for example, by one rotation in case of a rotational operation, or by one unit length (e.g., 1 millimeter) in case of a linear operation. Accordingly, the auxiliary handle is quickly attached to the main body of the power tool. In other words, operation amount is lessened for attaching of the auxiliary handle.

According to a further preferable aspect of the present disclosure, the operation member is formed as an elongate member. Further, a clamp member holding part which holds the first clamp member and the second clamp member is provided (fixed) on one end of the operation member, and the grip portion is provided (fixed) on another end of the operation member. The clamp member holding part includes (i) a first screw part on which a left screw thread is formed and (ii) a second screw part on which a right screw thread is formed. The first clamp member has a third screw part configured to mesh with the first screw part. Further, the second clamp member has a fourth screw part configured to mesh with the second screw part. The first screw part and the third screw part mesh with each other, while the second screw part and the fourth screw part mesh with each other at the same time by rotation of the operation member around its axis caused by a user as an attaching operation of the auxiliary handle. Thus, the first clamp member and the second clamp member move simultaneously to be close to each other in the axial direction of the operation member. As a result, the first clamp part and the second clamp part clamp the main body of the power tool and the auxiliary handle is attached to the power tool. Further, when the auxiliary handle is detached from the main body of the power tool, the operation member is rotated in an opposite direction opposite to the rotational direction of the attaching operation of the auxiliary handle. By the opposite rotation, the first clamp member and the second clamp member are simultaneously moved away from each other. A thread pitch of the right screw is preferably equal to a thread pitch of the left screw. On the other hand, the thread pitch of the right screw may differ from the thread pitch of the left screw. Further, the clamp member holding part may be formed as an elongate member and its axis may be inconformity with the axis of the operation member (grip portion).

According to this aspect, the clamp member holding part of the operation member meshes with the left screw formed on the first clamp member and the right screw formed on the second clamp member, respectively. Accordingly, when the operation member (clamp member holding part) is rotated by a user, the first clamp member and the second clamp member are simultaneously moved to be close to each other. As a result, changing rate of a distance between the first clamp member and the second clamp member becomes larger.

According to a further preferable aspect of the present disclosure, the clamp member holding part extends in the axial direction of the operation member. The first clamp member has a first arm which extends in a cross direction crossing the axial direction of the operation member. The first arm has the first clamp part. Further, the second clamp member has a second arm which extends in the cross direction. The second arm has the second clamp part. The first clamp member is arranged closer to the grip portion of the operation member than the second clamp member in the axial direction of the operation member. Accordingly, by an attaching operation (rotation) of a user when the auxiliary handle is attached to the power tool, the operation member is rotated around the axis of the operation member. Thus, the first clamp member is moved toward a distal end of the operation member opposite to a base end (grip portion), and at the same time the second clamp member is moved toward the base end (grip portion) of the operation member. As a result, the main body of the power tool is clamped by the first clamp part formed on the first arm and the second clamp part formed on the second arm.

According to this aspect, the first clamp member having the left screw is arranged at the base end side (grip portion side) of the operation member. Therefore, the first clamp member is moved toward the distal end by rotation to the right of the operation member. On the other hand, the second clamp member having the right screw is arranged at the distal end side of the operation member. Therefore, the second clamp member is moved toward the base end by rotation to the right of the operation member. Generally, mounting or attaching operation by means of a screw is performed by rotation to the right of a predetermined member such as jig, operating member and so on. In this respect, according to this aspect, the first and second arms clamp the main body of the power tool by rotation to the right of the operation member, and thereby the auxiliary handle is attached. That is, rotation to the right which is generally used for mounting or attaching via a screw is applied to attaching operation of the auxiliary handle. Accordingly, the attaching operation of the auxiliary handle to the power tool is user-friendly.

According to a further preferable aspect of the present disclosure, an auxiliary handle attachable part to which the auxiliary handle is attached is formed on the main body of the power tool. The auxiliary handle attachable part has a substantially circular section. Further, the first clamp part has a first arc which is configured to engage with the auxiliary handle attachable part, and the second clamp part has a second arc which is configured to engage with the auxiliary handle attachable part. Further, in a state that the auxiliary handle is attached to the auxiliary handle attachable part, the first arc and the second arc form a predetermined arc whose a center angle exceeds 180 degrees. Accordingly, in a state that the auxiliary handle is attached to the auxiliary handle attachable part, the center of the first arc and the center of the second arc match with each other. Further, the center of the first arc and the center of the second arc match with the center of the auxiliary handle attachable part.

According to this aspect, the center angle of the arc defined by the first arc and the second arc exceeds 180 degrees. Accordingly, even if clamping force by the first clamp part and the second clamp part is not enough for holding (clamping) the main body, the first and second clamp member are prevented from being released from the main body due to its arc shape.

According to a further preferable aspect of the present disclosure, the auxiliary handle further comprises a relative rotation preventing mechanism which prevents relative rotation of the first clamp member against the second clamp member around an axis of the clamp member holding part. In other words, relative rotation between the first clamp member and the second clamp member is prevented. Typically, the relative rotation preventing mechanism comprises a projection which is formed on one member between the first clamp member and the second clamp member and a recess which is formed on another member between the first clamp member and the second clamp member. The projection and the recess extend in the axial direction of the clamp member holding part. Further, the projection and the recess are configured to engage with each other. Further, in a state that the projection and the recess are engaged with each other, the first clamp member and the second clamp member are allowed to relatively move to each other in the axial direction of the clamp member holding part. The relative rotation prevention mechanism may be arranged on each side part of the first clamp member and the second clamp member. That is, the projection serves as one element of the relative rotation preventing mechanism is provided on a side surface of one of the first and second arms. Further, the recess serves as one element of the relative rotation preventing mechanism is provided on a side surface of another member of the first and second arms. The side surfaces of the first and second arms are defined by surfaces of the first and second arms parallel to an extending direction of the arms. Typically, the side surface is defined by a surface whose normal direction is in conformity with the central axial direction of the first arc of the first clamp part and the second arc of the second clamp part. Accordingly, the relative rotation preventing mechanism is arranged so as to protrude from the first and second arms, respectively.

According to this aspect, relative rotation between the first clamp member and the second clamp member around the axis of the clamp member holding part is prevented by the relative rotation preventing mechanism. Accordingly, the auxiliary handle is efficiently attached to the main body of the power tool. Further, since the relative rotation preventing mechanism is arranged on the side parts of the first and second clamp member, the relative rotation preventing mechanism does not interfere with an operation against a workpiece performed by the power tool to which the auxiliary handle is attached.

According to a further preferable aspect of the present disclosure, a screw diameter of the first screw part is larger than a screw diameter of the second screw part. Typically, the clamp member holding part is formed cylindrically. Further, the first screw part is provided by a male thread which is formed on an outer surface of the clamp member holding part, and the second screw part is provided by a female thread which is formed on an inner surface of the clamp member holding part. Further, the first screw part and the second screw part are provided so as to overlap to each other in the axial direction of the clamp member holding part.

According to this aspect, the screw diameter of the first screw part and the screw diameter of the second screw part are different from each other. Accordingly, the first screw part and the second screw part are formed on a singular member which has at least two kinds of diameter portions. Specifically, in a case that the clamp member holding part is formed cylindrically, the inner surface and the outer surface of the clamp member holding part are rationally utilized for the first and second screw parts. Further, the first screw part and the second screw part are arranged so as to overlap to each other in the axial direction of the clamp member holding part, and thereby length of the clamp member holding part is shortened.

According to a further preferable aspect of the present disclosure, one of the first clamp member and the second clamp member has a handle side engagement part which is configured to engage with a main body side engagement part formed on the main body. Further, in a state that the auxiliary handle is attached to the main body of the power tool, the handle side engagement part engages with the main body side engagement part, and thereby the auxiliary handle is prevented from moving with respect to the main body by an engagement of the handle side engagement part and the main body side engagement part.

According to this aspect, relative movement of the auxiliary handle with respect to the main body of the power tool is prevented by the handle side engagement part and the main body side engagement part. In such a case, relative movement of the auxiliary handle preferably includes relative linear movement of the auxiliary handle in the axial direction of the tool bit with respect to the power tool, and relative rotation of the auxiliary handle around the axis of the tool bit with respect to the power tool.

According to a further preferable aspect of the present disclosure, a power tool which has the auxiliary handle described above is provided. The power tool is configured to drive a tool bit having its axis and perform a predetermined operation. The predetermined operation preferably includes a screw tightening operation, a screw untightening operation, a hammering operation or a drilling operation like that. The power tool comprises a main body which has an auxiliary handle attachable part to which the auxiliary handle is detachably attached, and a main handle which is connected to the main body. The main handle has a main grip which extends in a cross direction crossing an axial direction of the tool bit. Further, the auxiliary handle attachable part is configured such that the grip portion of the auxiliary handle is attached to the auxiliary handle attachable part in such a manner that the grip portion of the auxiliary handle extends in a direction crossing both of the axial direction of the tool bit and the cross direction. According to such attaching aspect of the auxiliary handle, the main grip of the main handle and the grip portion of the auxiliary handle are arranged in a crossing (intersectional) manner. As a result, a more user friendly power tool in terms of holding by a user during the operation is provided.

According to a further preferable aspect of the present disclosure, a power tool which has the auxiliary handle described above is provided. The power tool is configured to drive a tool bit having its axis and perform a predetermined operation. The predetermined operation preferably includes a screw tightening operation, a screw untightening operation, a hammering operation or a drilling operation like that. The power tool comprises a main body which has an auxiliary handle attachable part to which the auxiliary handle is detachably attached. The auxiliary handle attachable part is formed cylindrically and is arranged coaxially with the axis of the tool bit. Further, the main body side engagement part is provided by a plurality of main body side projections each of which is arranged at each part on the auxiliary handle attachable part in a circumference direction of the auxiliary handle attachable part. Further, the handle side engagement part is provided by a handle side recess which is formed on one of the first clamp member and the second clamp member. Further, in a state that the auxiliary handle is attached to the auxiliary handle attachable part, the handle side recess is selectively engaged with one of the main body side projections, and thereby the auxiliary handle is prevented from rotating around the axis of the tool bit with respect to the main body (auxiliary handle attachable part) by an engagement of the handle side recess and the main body side projection.

According to this aspect, one of the main body side projections is selectively engaged with the handle side recess. Accordingly, a plurality of attaching aspects (angles) is arbitrarily selected by a user based on an operational aspect of the power tool. Further, in each selected attaching aspect, relative rotation of the auxiliary handle with respect to the main body of the power tool is prevented. As a result, the auxiliary handle is stably held (attached).

Accordingly, an improved technique for attaching an auxiliary handle to a power tool is provided.

Other objects, features and advantages of the present disclosure will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved auxiliary handles and method for using such auxiliary handles and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
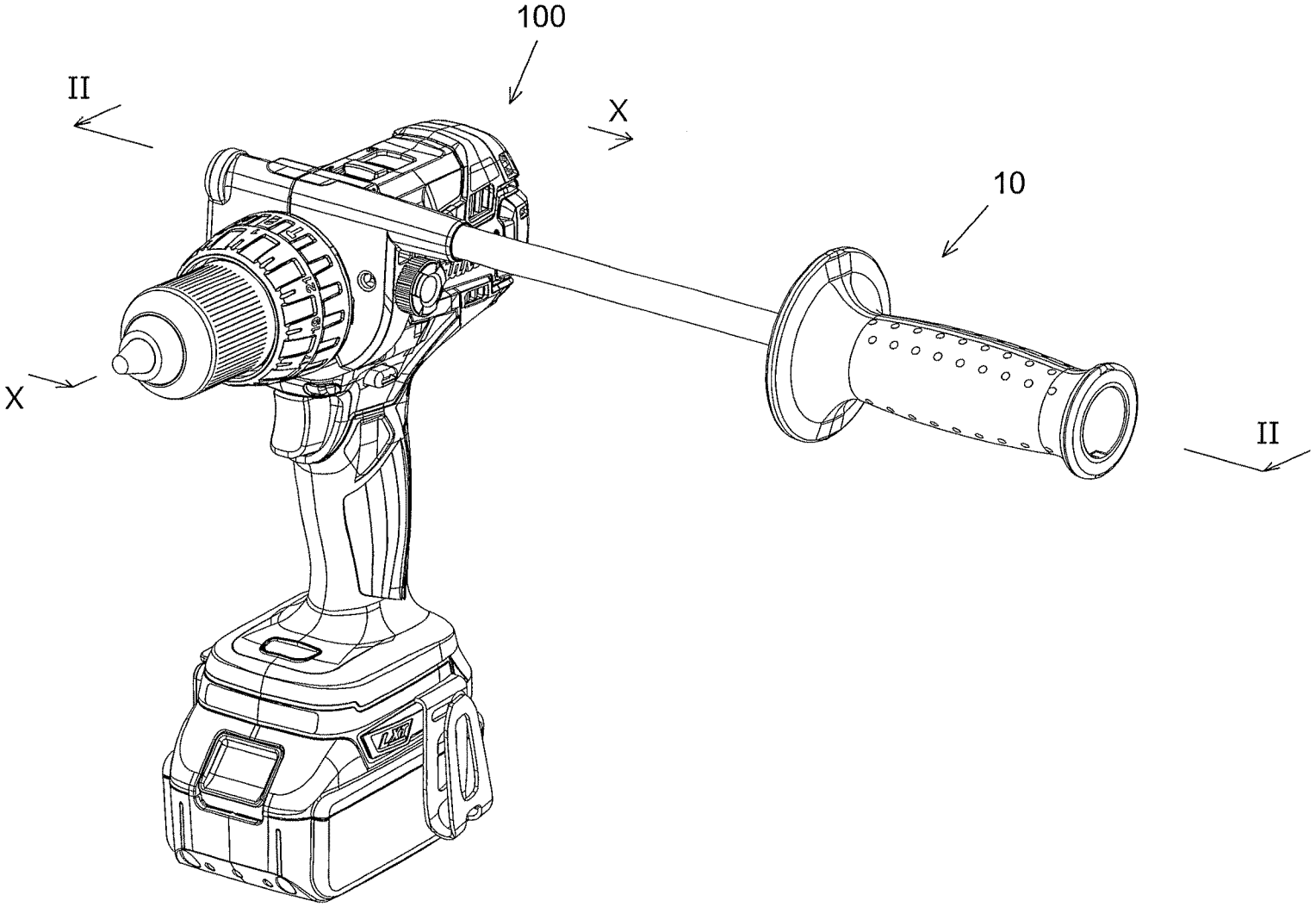
FIG. 1 shows a cross sectional view of a screw driver having an auxiliary handle according to an exemplary embodiment of the present disclosure.

An exemplary embodiment of the present disclosure is explained with reference to FIG. 1 to FIG. 21. As shown in FIG. 1, an auxiliary handle 10 is detachably attached to a screw driver 100 as one example of a power tool. The screw driver 100 is used for tightening a screw to a workpiece such as a plaster board. The auxiliary handle is one example which corresponds to "an auxiliary handle" of this disclosure.

(Construction of the Auxiliary Handle)

Figure 2:
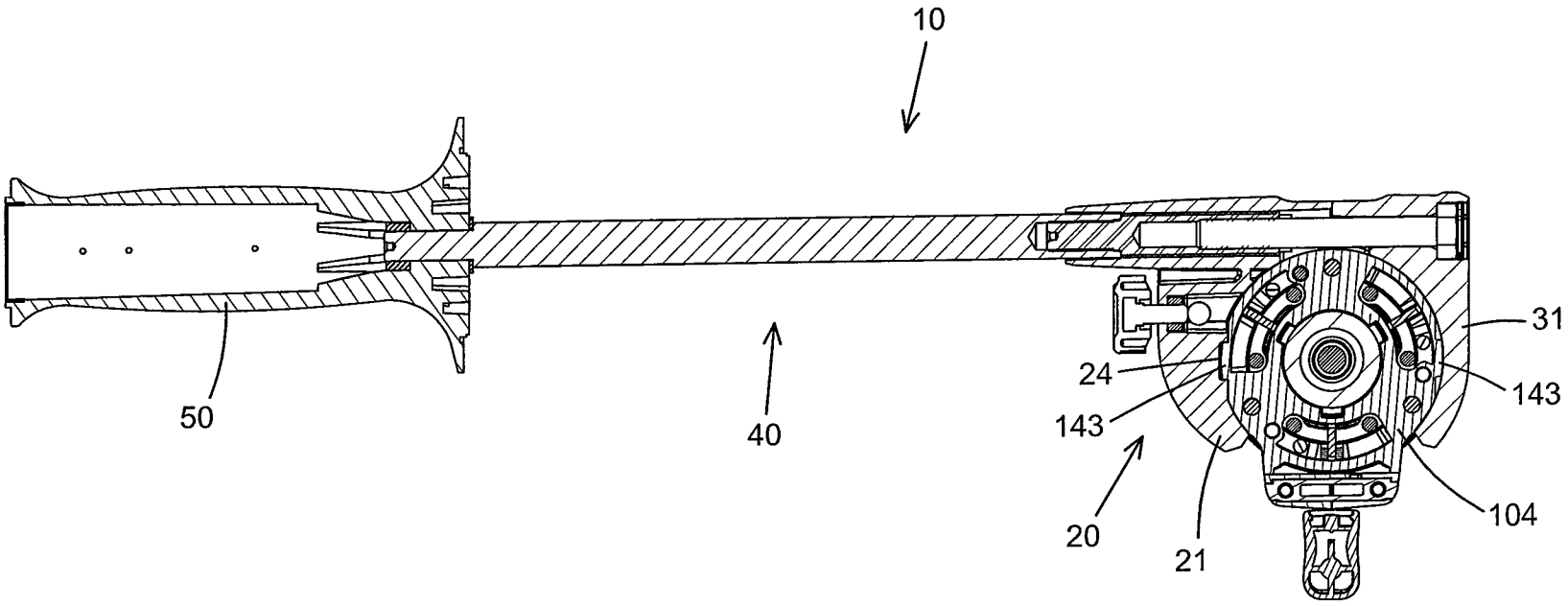
FIG. 2 shows a cross sectional view taken along the II-II line in FIG. 1.
Figure 3:
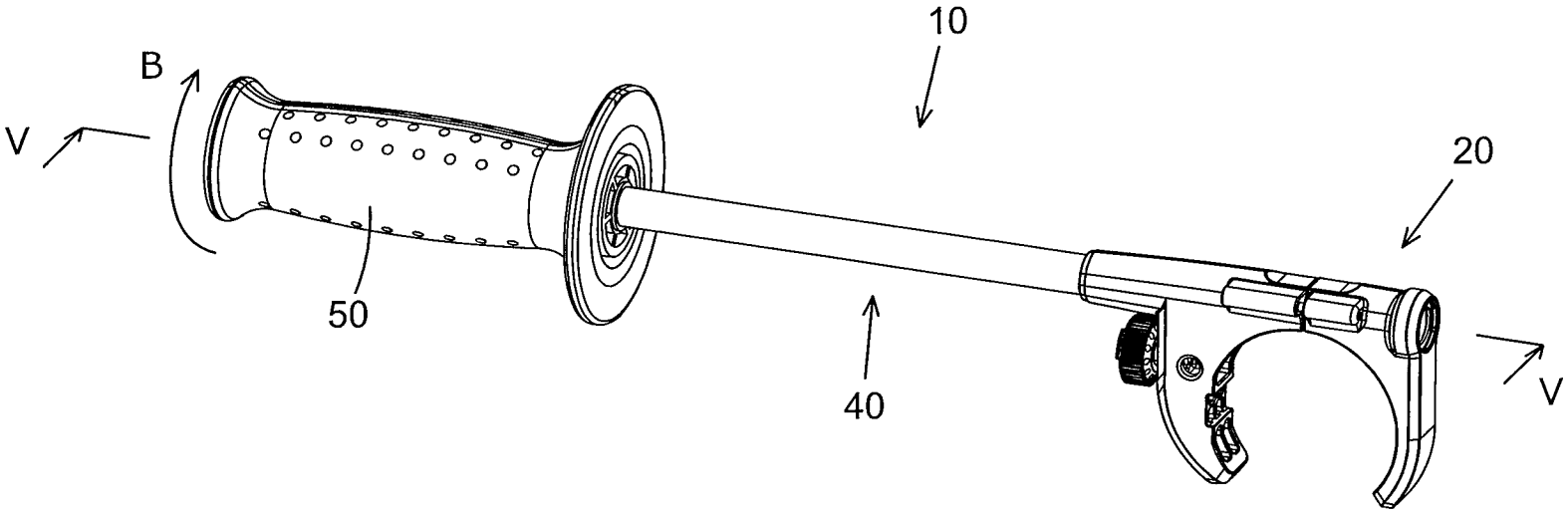
FIG. 3 shows a perspective view of the auxiliary handle.

As shown in FIG. 2 and FIG. 3, the auxiliary handle is mainly provided with a clamping mechanism 20, an operation rod 40 and a grip 50. The clamping mechanism 20 is mainly provided with a first clamp member 21 and a second clamp member 31. The clamp mechanism 20 clamps and holds a gear housing 104 of the screw driver 100 such that the first clamp member 21 and the second clamp member 31 surround more than a half of circumference of a barrel part of the gear housing 104. Thus, the auxiliary handle 10 is attached to the screw driver 100.

Figure 4:
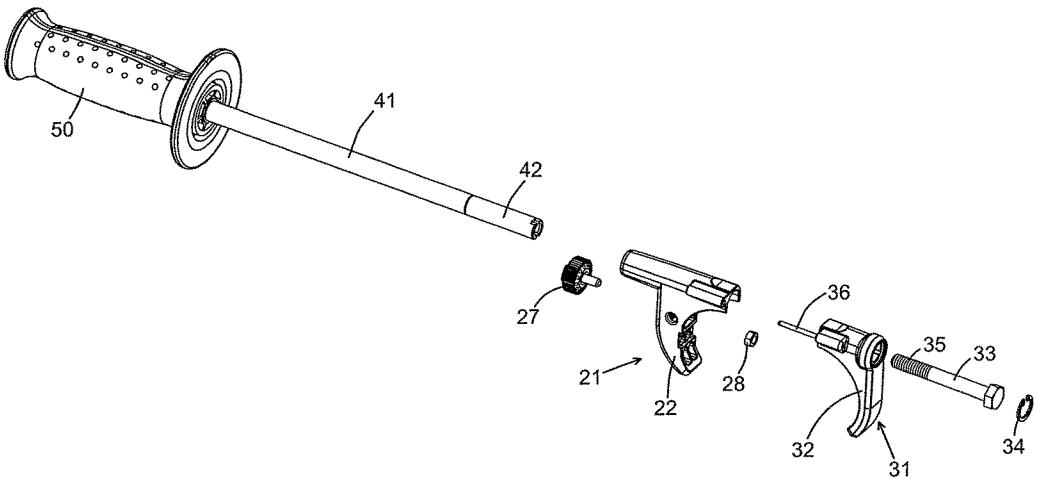
FIG. 4 shows an exploded view of the auxiliary handle.
Figure 5:
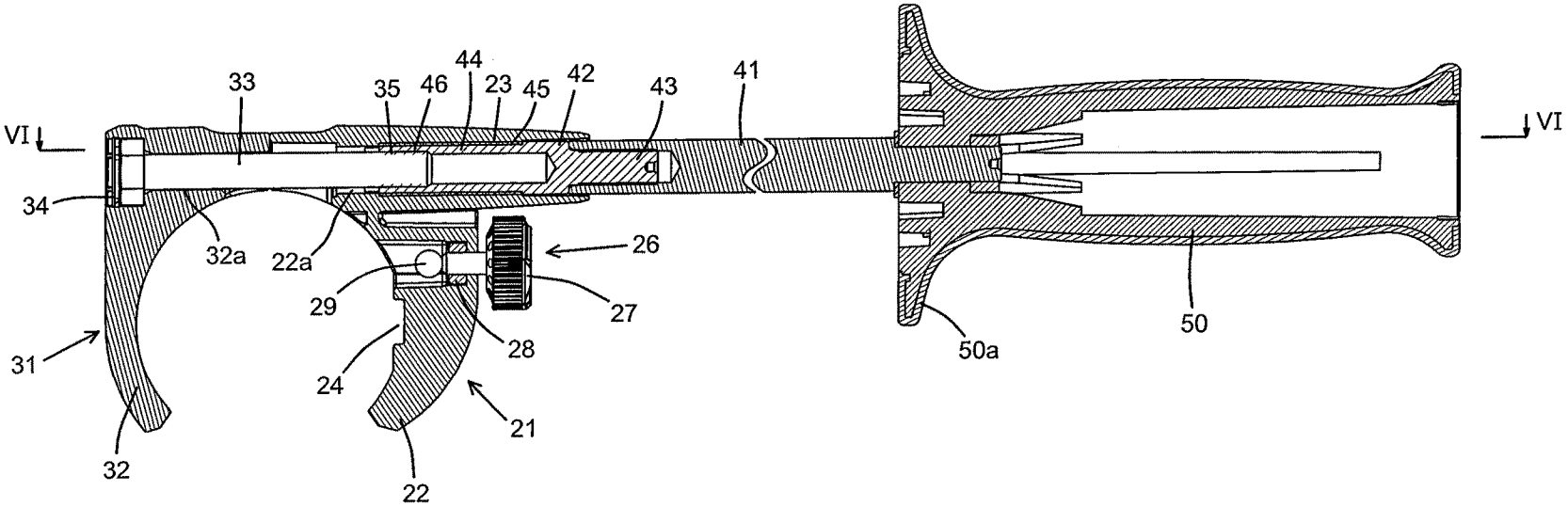
FIG. 5 shows a cross sectional view taken along the V-V line in FIG. 3.
Figure 6:
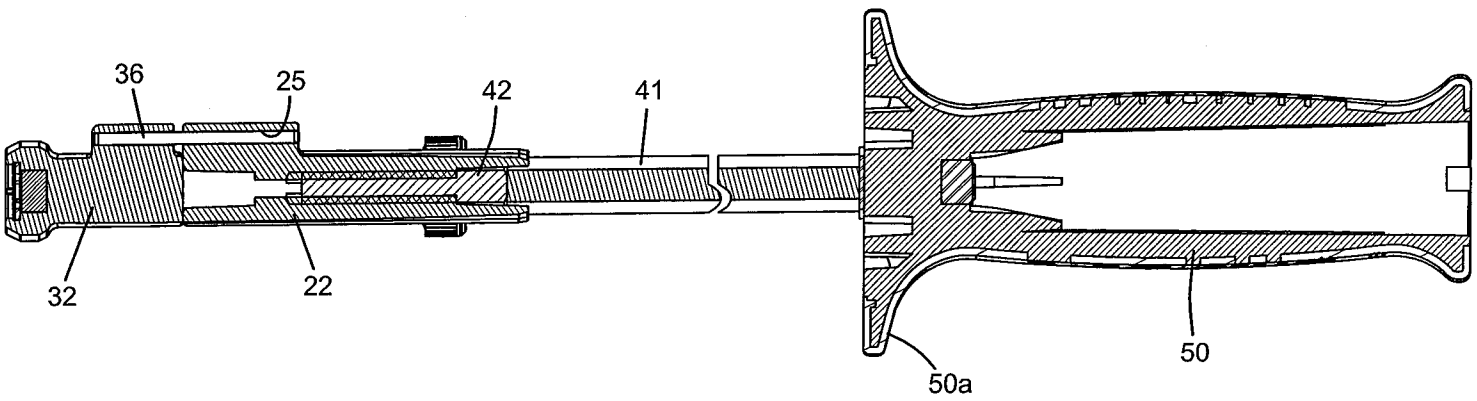
FIG. 6 shows a cross sectional view taken along the VI-VI line in FIG. 5.

As shown in FIG. 4 to FIG. 6, the first clamp member 21 comprises a first engagement part 22, a first female thread part 23, an engagement recess 24, a pin sliding part 25 and a stopping pole attached part 26. A part of the first engagement part 22, which faces the second clamp member 31, is formed in an arc shape. The arc shaped part has the engagement recess engageable with a rotation preventing part (shown in FIG. 2) of a main body 101 of the screw driver 100. Further, the first engagement part 22 has a rod engaging hole 22*a* which is formed to penetrate the first engagement part 22. The first female thread part 23 is a left screw female thread formed on the inner surface of the rod engaging hole 22*a*. The first clamp member 21 is one example which corresponds to "a first clamp member" of this disclosure. Further, the first engagement part 22 and the first female thread part 23 are respective example which correspond to "a first arm" and "a third screw part" of this disclosure, respectively. Further, the arc shaped part of the first engagement part 22 is one example which corresponds to "a first clamp part" of this disclosure.

The pin sliding part 25 is provided with a through-hole which extends in parallel with the rod engaging hole 22. A pin 36 of the second clamp member 31 is inserted into the through-hole of the pin sliding part 25. The pin sliding part 25 is formed on the side surface of the first engagement part 22.

The stopping pole attached part 26 is mainly provided with a bolt 27, a nut 28 and a stopping pole engaging hole 29. The stopping pole engaging hole 29 is provided to penetrate the first engagement part 22 such that the stopping pole engaging hole 29 extends perpendicular to the rod engaging hole 22*a*. The bolt 27 is screwed into the nut 28 in a state that a stopping pole (not shown) is inserted into the stopping pole engaging hole 29, thereby a tip portion of the bolt 27 contacts with the side surface of the stopping pole and holds the stopping pole. The stopping pole is configured to define the depth of a screwing screw into a workpiece.

As shown in FIG. 4 to FIG. 6, the second clamp member 31 is mainly provided with a second engagement part 32, a rod engaging bolt 33, a circular stopper 34 and the pin 36. A part of the second engagement part 32, which faces the first clamp member 21, is formed in an arc shape. A bolt engaging hole 32*a* is formed so as to penetrate the second engagement part 32. A tip portion of the bolt engaging hole 32*a* has a hexagonal inner section which engages with the head of the rod engaging bolt 33. The rod engaging bolt 33 is inserted into the bolt engaging hole 32*a* and the rod engaging bolt 33 is preventing from being dropped off from the bolt engaging hole 32*a* by the circular stopper 34 which engages with the bolt engaging hole 32*a*. The rod engaging bolt 33 has a second male thread part 35 which is provided by a right screw male thread. The second clamp member 31 is one example which corresponds to "a second clamp member" of this disclosure. Further, the second engagement part 32 and the second male thread part 35 are respective examples which correspond to "a second arm" and "a fourth screw part" of this disclosure. Further, the arc shaped part of the second engagement part 32 is one example which corresponds to "a second clamp part" of this disclosure.

The pin 36 is fixed on the outer surface of the second engagement part 32. The pin 36 is provided parallel to the rod engaging bolt 33. The first clamp member 21 and the second clamp member 31 are assembled to each other such that the pin 36 is inserted into the through-hole of the pin sliding part 25.

As shown in FIG. 4 to FIG. 6, the operation rod 40 is a connecting member which connects the clamping mechanism 20 and a grip 50. The operation rod 40 is mainly provided with a rod member 41 and a screw member 42. The screw member 42 is mounted on one end of the rod member 41 and the grip 50 is mounted on another end of the rod member 41. In other words, the rod member 41, the screw member 42 and the grip 50 are integrally formed. The operation rod 40 and the screw member are respective examples which correspond to "an operation member" and "a clamp member holding part" of this disclosure.

As shown in FIG. 4 to FIG. 6, the screw member 42 is mainly provided a cylindrical connecting part 43 and a cylindrical operation screw part 44. The connecting part 43 is fitted into the rod member 41, thereby the screw member 42 and the rod member 41 are connected to each other. A first male thread part 45 is formed on the outer surface of the operation screw part 44. The first male thread part 45 is provided by a male thread which meshes (engages) with a female thread of the first female thread part 23. Further, a second female thread part 46 is formed on the inner surface of the operation screw part 44. The second female thread part 46 is provided by a female thread which meshes (engages) with a male thread of the second male thread part 35. That is, a diameter of the first male thread part 45 is larger than a diameter of the second female thread part 46. Further, the first male thread part 45 is provided so as to overlap with at least in part of the second female thread part 46 in a longitudinal direction of the screw member 42. The first female thread part 45 and the second female thread part 46 are respective examples which correspond to "a first thread part" and "a second thread part" of this disclosure.

As shown in FIG. 4 to FIG. 6, the grip 50 serves as a grip which is held by a user. The grip 50 is provided (mounted) on the opposite end of the operation rod 40, which is opposite to the clamping mechanism 20 in a longitudinal direction of the operation rod 40. The grip 50 and the operation rod 40 are configured to rotate integrally around the longitudinal direction of the grip 50 (longitudinal direction of the auxiliary handle 10). The grip 50 is made of resin material. The grip 50 includes a flange 50*a* at its operation rod 40 side. The grip 50 is one example which corresponds to "a grip portion" of this disclosure.

(Operation of the Auxiliary Handle)

Figure 7:
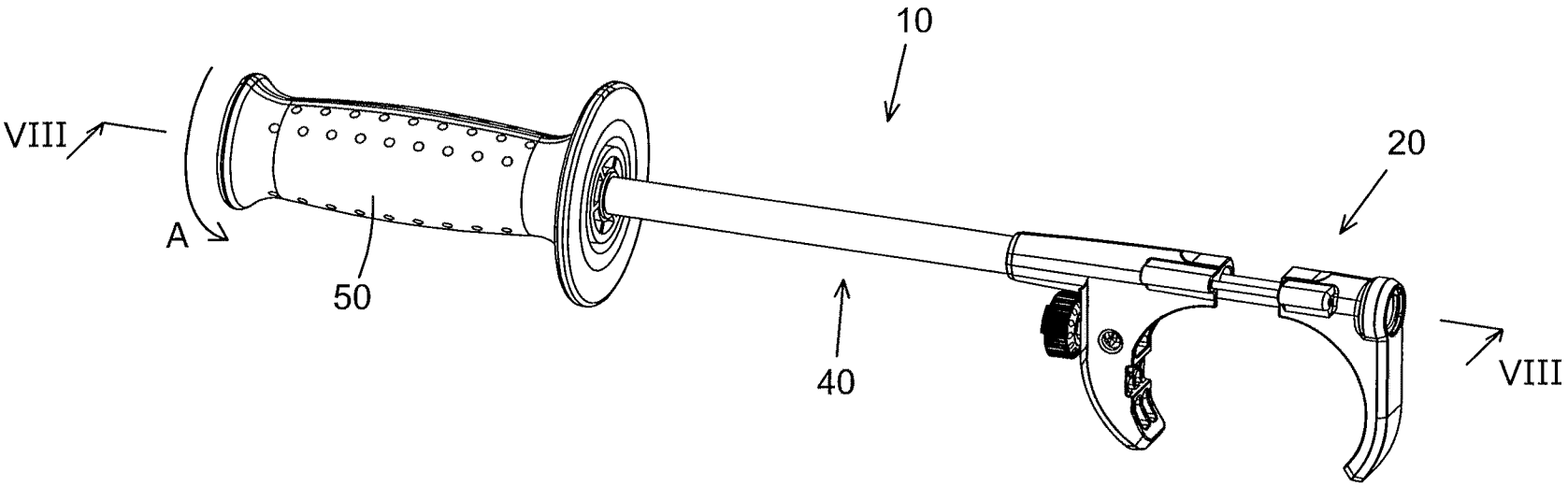
FIG. 7 shows a perspective view in which a first clamp member and a second clamp member are arranged distantly to each other.
Figure 8:
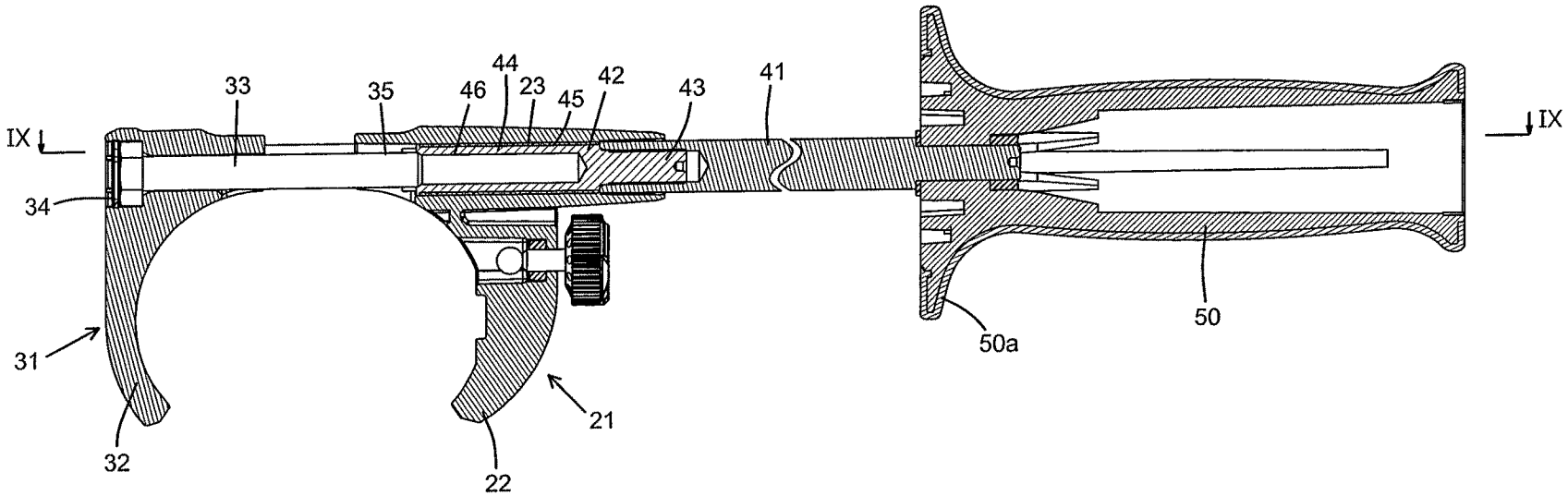
FIG. 8 shows a cross sectional view taken along the VIII-VIII line in FIG. 7.
Figure 9:
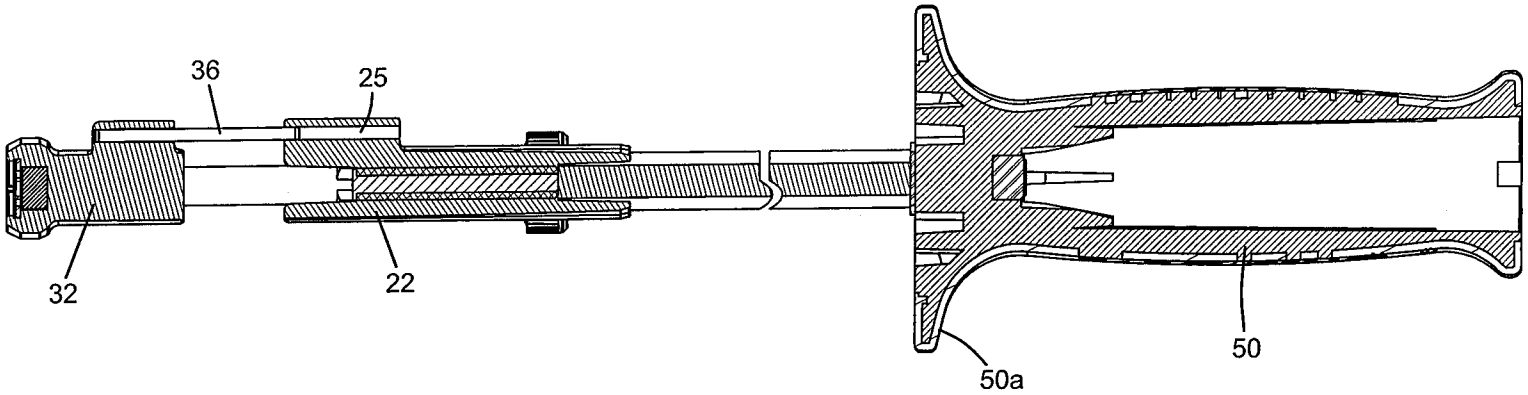
FIG. 9 shows a cross sectional view taken along the IX-IX line in FIG. 8.

In the auxiliary handle 10, the operation rod 40 operates the clamping mechanism 20 by rotating the grip 50 by a user. Specifically, as shown in FIG. 7 to FIG. 9, when the grip 50 is rotated in a clockwise direction which is indicated by an arrow A (hereinafter referred to as A-direction) in a state that the first clamp member 21 which is provided on a base side (grip 50 side) of the auxiliary handle 10 and the second clamp member 31 which is provided on a distal end side of the auxiliary handle 10 are distantly located in the longitudinal direction of the auxiliary handle 10, the first clamp member 21 and the second clamp member 31 are operated (moved) by the operation rod 40 (operation screw part 44). That is, the first male thread part 45 of the operation rod 40 and the first female thread part 23 of the first clamp member 21, which are respectively provided with the left screw, mesh with each other and thereby the first clamp member 21 moves away from the grip 50 toward the distal end of the operation rod 40 by rotation of the grip 50 in A-direction. In other words, the first clamp member 21 is relatively moved with respect to the operation rod 40.

On the other hand, the second female thread part 46 of the operation rod 40 and the second male thread part 35 of the second clamp member 31, which are respectively provided with the right screw, mesh with each other and thereby the second clamp member 31 moves to be close to the grip 50 toward the base end of the operation rod 40 by rotation of the grip 50 in A-direction. In other words, the second clamp member 31 is relatively moved with respect to the operation rod 40. As described above, the first clamp member 21 and the second clamp member 31 are moved simultaneously to be close to each other by rotation of the grip 50 in A-direction. In this case, a part of the first clamp member 21 facing the second clamp member 31 and a part of the second clamp member 31 facing the first clamp member 21 contact with each other and thereby the first clamp member 21 and the second clamp member 31 are prevented from moving. The position (hereinafter referred to as holding position) in which the first clamp member 21 and the second clamp member 31 are prevented from moving to be close to each other is indicated in FIG. 5. As a result, as shown in FIG. 2, the gear housing 104 of the screw driver 100 is clamped by the first clamp member 21 and the second clamp member 31. Thus, the auxiliary handle 10 is attached to the screw driver 100.

When the first clamp member 21 and the second clamp member 31 are relatively moved to be close to each other in the longitudinal direction of the operation rod 40, the pin 36 is slid within the pin sliding part 25. Thus, relative rotation between the first clamp member 21 and the second clamp member 31 in a circumference direction around the longitudinal direction of the operation rod 40 is prevented by engagement between the pin 36 and the through-hole of the pin sliding part 25. The pin 36 and the pin sliding part 25 are respective examples which correspond to "a projection" and "a recess" of this disclosure. Accordingly, the pin 36 and the pin sliding part 25 serve as "a relative rotation preventing mechanism" of this disclosure.

As shown in FIG. 2, respective tip ends of the first clamp member 21 and the second clamp member 31 are located such that each clamp member extends so as to exceed the center of a barrel part of the gear housing 40 in a direction (vertical direction in FIG. 2) perpendicular to the longitudinal direction of the operation rod 40 in a state that the auxiliary handle 10 is attached to the gear housing 104. That is, the central angle of the arc which is formed by the first engagement part 22 and the second engagement part 32 is defined as more than 180 degrees. Further, the engagement recess 24 of the first clamp member 21 engages with the rotation preventing part 143 of the gear housing 104 in a state that the auxiliary handle 10 is attached to the gear housing 104. Accordingly, rotation of the attached auxiliary handle 10 around the gear housing 104 is prevented. The engagement recess 24 is one example which corresponds to "a handle side engagement part" and "a handle side recess" of this disclosure. Further, the rotation preventing part 143 is one example which corresponds to "a main body side engagement part" and "a main body side projection" of this disclosure.

Further, as shown in FIG. 3, FIG. 5 and FIG. 6, when the grip 50 is rotated in a counter clockwise direction which is indicated by an arrow B in FIG. 3 (hereinafter referred to as B-direction) in a state that the first clamp member 21 and the second clamp member 31 are located closely to each other, the first clamp member 21 and the second clamp member 31 are operated (moved) by the operation rod 40. That is, the first male thread part 45 of the operation rod 40 and the first female thread part 23 of the first clamp member 21, which are respectively provided with the left screw, mesh with each other and thereby the first clamp member 21 moves to be close to the grip 50 toward the base end of the operating rod 50 by the rotation of the grip 50 in B-direction. On the other hand, the second female thread part 46 of the operation rod 40 and the second male thread part 35 of the second clamp member 31, which are respectively provided with the right screw, mesh with each other and thereby the second clamp member 31 moves away from the grip 50 toward the distal end of the operation rod 40 by rotation of the grip 50 in B-direction.

As described above, the first clamp member 21 and the second clamp member 31 are moved simultaneously away from each other by rotation of the grip 50 in B-direction. Thus, the first clamp member 21 and the second clamp member 31 are located in a position (hereinafter referred to as release position) indicated in FIG. 8. As a result, the attached auxiliary handle 10 to the screw driver 100 as shown in FIG. 2 is detached from the screw driver 100.

(Construction of the Screw Driver)

Figure 10:
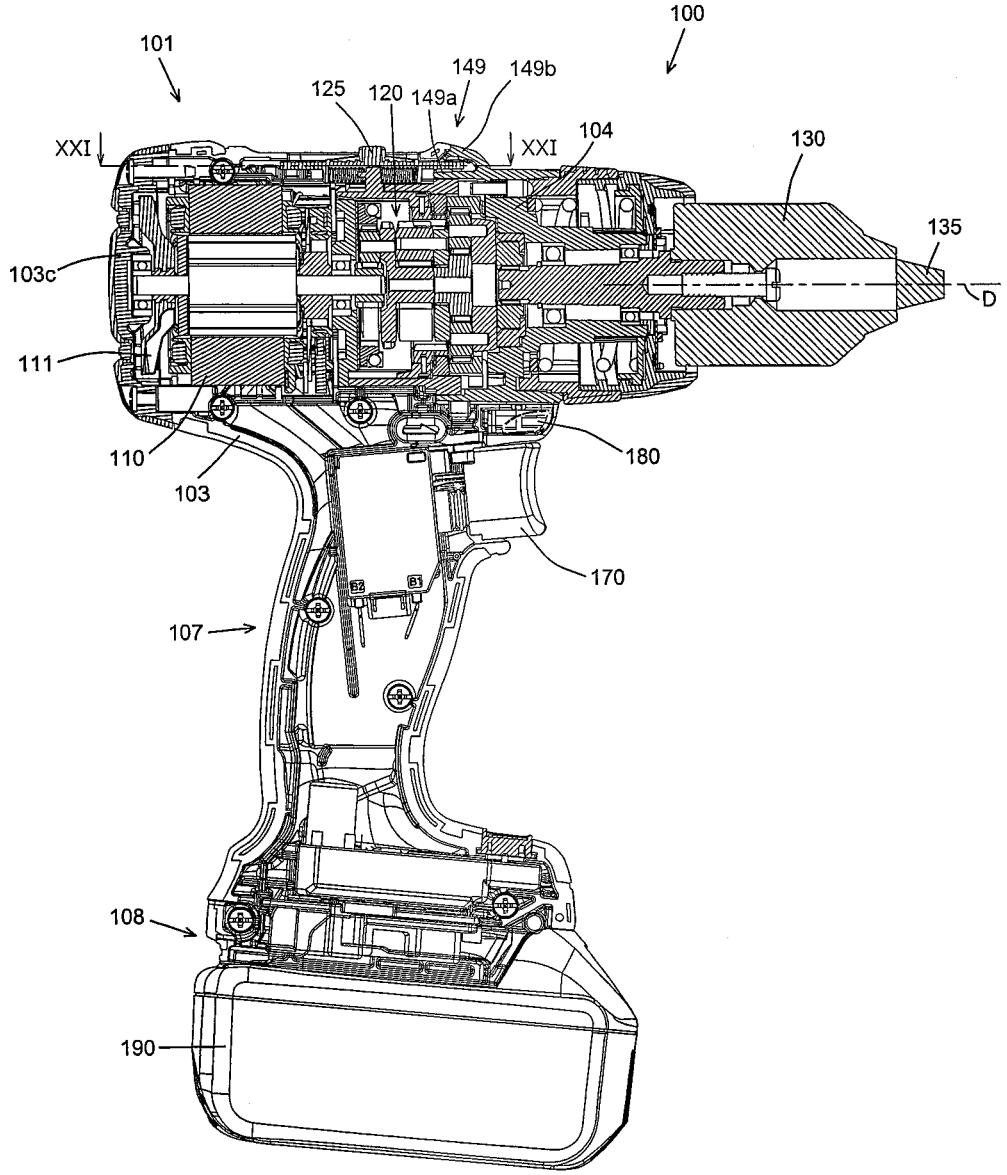
FIG. 10 shows a cross sectional view taken along the X-X line in FIG. 1.

As shown in FIG. 10, the screw driver 100 is mainly provided with a main body 101. The main body 101 is mainly provided with a main housing 103, the gear housing 104 and a tool holder 130.

Figure 11:
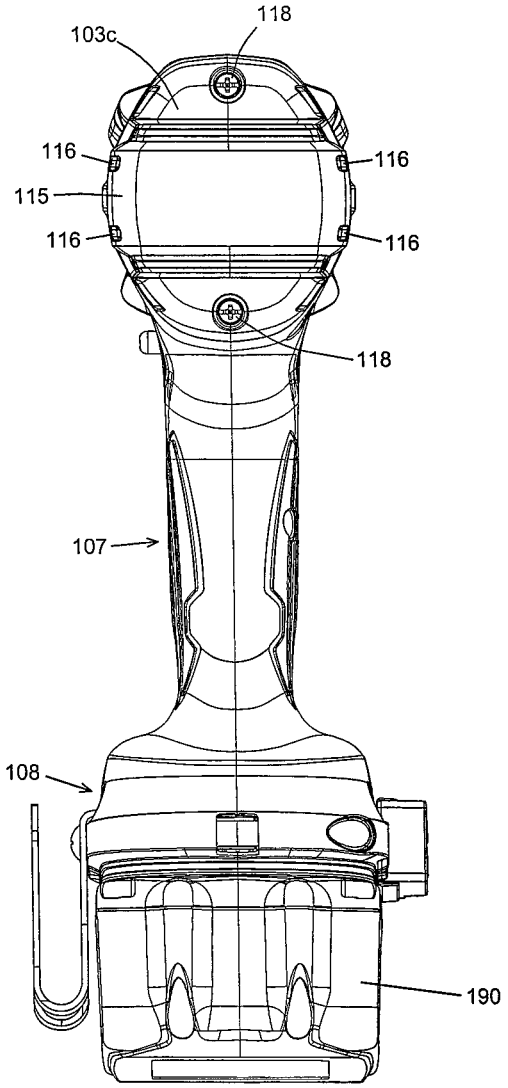
FIG. 11 shows a back view of the screw driver.
Figure 12:
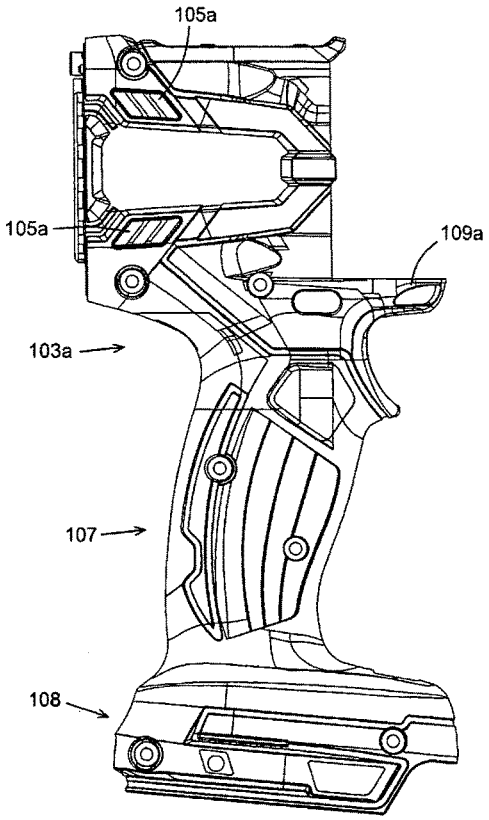
FIG. 12 shows a side view of a right housing of the screw driver.

As shown in FIG. 11 to FIG. 16, the main housing 103 is provided with a right housing 103*a*, a left housing 103*b* and a rear cover 103*c* which are made of resin material. As shown in FIG. 10, an inner space of the main housing 103 is defined by connecting the right housing 103*a* and the left housing 103*b*. In the inner space of the main housing 103, a brushless motor 110, a fan 111 and a rear part of a driving mechanism 120 are provided. The right housing 103*a* and the left housing 103*b* include a handle 107 held by a user. The handle 107 has a substantially oval section with respect to a front-rear direction of the screw driver 100. Further, as shown in FIG. 12, each side surface of the right housing 103*a* and the left housing 103*b* has each air inlet 105*a*, 105*b*.

As shown in FIG. 10, the handle 107 extends from a proximal side which is proximal to the brushless motor 110 in a direction crossing a rotational axis of the brushless motor 110. At the proximal side of the handle 107, a trigger 107*a* which is operated by a user is provided. Further, at a distal side of the handle 107, a battery attachable part 108 to which a battery 190 is detachably attached is provided.

Figure 14:
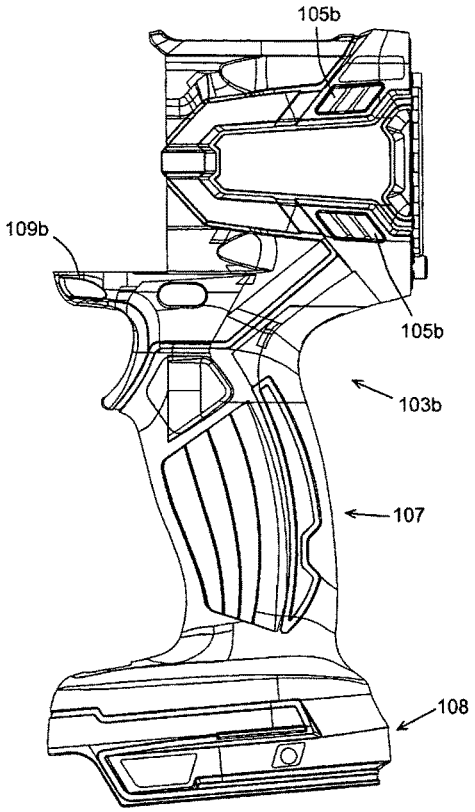
FIG. 14 shows a side view of a left housing of the screw driver.

As shown in FIG. 10, two LEDs 180 which irradiate light to an operated area on a workpiece are arranged at an upper region than the trigger 107. As shown in FIG. 12 and FIG. 14, each of the right housing 103*a* and the left housing 103*b* has each light holding part 109*a*, 109*b* for holding each LED 180. The light holding parts 109*a*, 109*b* is formed so as to protrude frontward (right side of FIG. 10) than the trigger 107.

As shown in FIG. 10, the rear cover 103 holds a rear bearing which rotatably supports a rotational shaft of the motor 110. The rear bearing is arranged such that it overlaps with the fan 111 in the front-rear direction of the screw driver 100. Thus, a length of the screw driver 100 in the front-rear direction is shortened.

Figure 16:
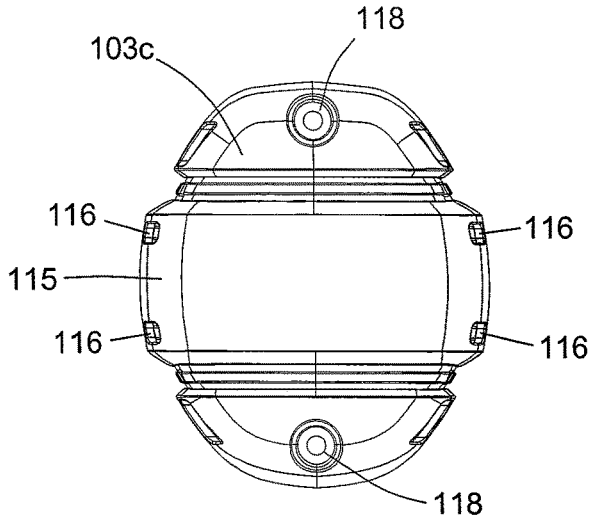
FIG. 16 shows a back view of a rear cover of the screw driver.
Figure 17:
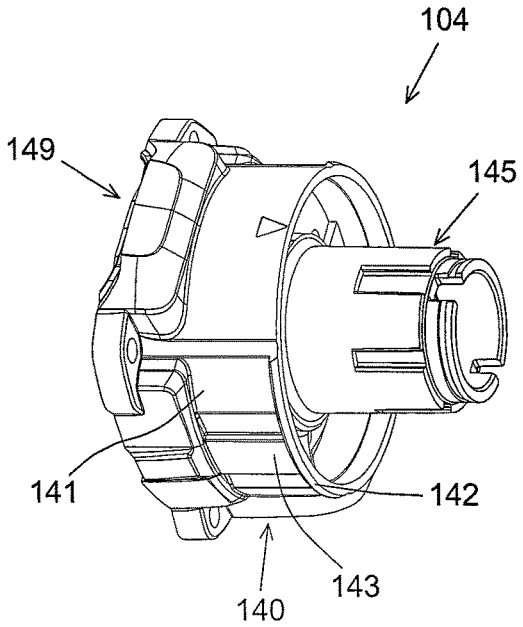
FIG. 17 shows a perspective view of a gear housing of the screw driver.
Figure 18:
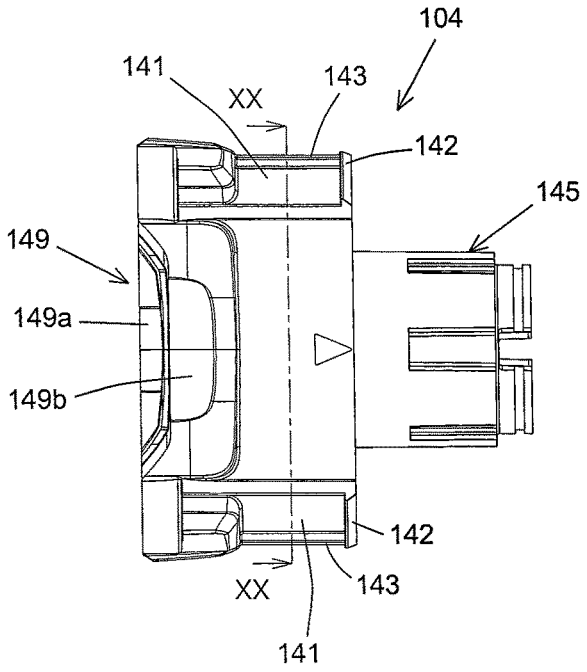
FIG. 18 shows a top view of the gear housing.

Further, as shown in FIG. 11 and FIG. 16, the rear cover 103*c* includes an elastomer 115 which protects a rear part of the screw driver 100. In the rear part of the screw driver 100, four air outlets 116 are formed so as to penetrate the rear cover 103*c* and the elastomer 115. When the fan 111 is driven by the brush less motor 110, outer air is flowed into the inner space of the main housing 103 via the air inlet 105*a*, 105*b* formed on the right housing 103*a* and the left housing 103*b* respectively. The outer air flowed into the main housing 103 is passed outside the brushless motor 110 and flowed to a frontward region of the brushless motor 110, thereafter the cooling air is passed inside the brushless motor 110 and exhausted from the air outlet 116. Accordingly, the brushless motor 110 is cooled by the cooling air.

Figure 13:
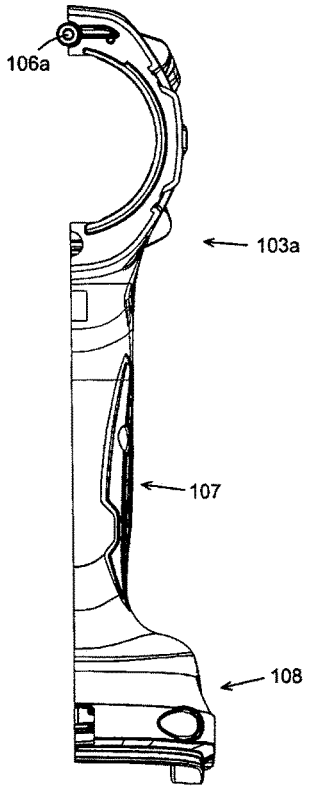
FIG. 13 shows a back view of the right housing.
Figure 15:
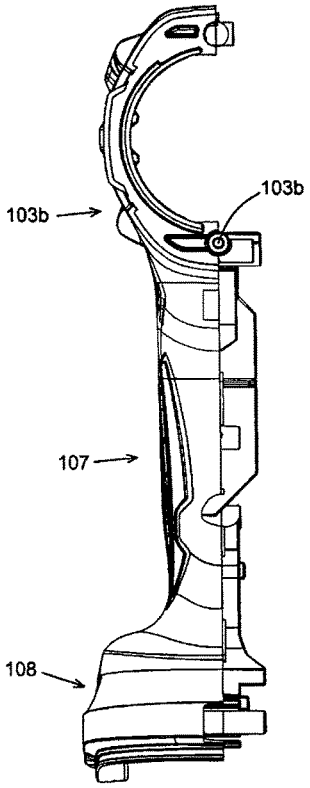
FIG. 15 shows a back view of the left housing.

As shown in FIG. 13, the right housing 103*a* has a boss hole part 106*a* which is formed on a surface of the right housing 103*a* facing (contacting with) the left housing 103*b*. Further, as shown in FIG. 15, the left housing 103*b* has a boss hole part 106*b* formed on a surface of the left housing 103*b* facing (contacting with) the right housing 103*a*. Thus, the boss hole parts 106*a*, 106*b* are arranged on a central surface of the screw driver 100, which passes the gravity center of the screw driver 100 as well as a tool bit 135.

On the other hand, as shown in FIG. 16, two screw holes 117 are formed on an upper region and a lower region of the rear cover 103*c*. The upper screw hole 117 corresponds to the boss hole part 106*a* of the right housing 103*a* and the lower screw hole 117 corresponds to the boss hole part 106*b* of the left housing 103*b*. As shown in FIG. 11, the rear cover 103*c* is mounted on the right housing 103*a* and the left housing 103*b* by two screws 118, respectively. In such a construction, as the boss hole parts 106*a*, 160*b* are formed on the central surface of the screw driver 100, the rear cover 103*c* is stably held by the right housing 103*a* and the left housing 103*b*.

As shown in FIG. 10, the gear housing 104 is arranged in front (right side of FIG. 10) of the main housing 103. The gear housing 104 houses a front part of the driving mechanism 120 which is provided with a planetary gear apparatus. The planetary gear apparatus is provided with three planetary gear mechanisms. Specifically, two planetary gear mechanisms are selectively utilized among the three planetary gear mechanisms and the selected planetary gear mechanisms transmit torque of the brushless motor 110 to a tool bit 135 held by the tool holder 130. For switching the planetary gear mechanisms utilized to transmit torque, a switching lever 125 is provided on the top of the screw driver 100. Thus, torque (rotation speed) from the driving mechanism 120 is changed by selectively switching the planetary gear mechanisms by the switching lever 125. The driving mechanism 120 is driven by the brushless motor 110. When the trigger 107*a* is pulled (manipulated) by a user, the brushless motor 110 is driven.

As shown in FIG. 1, the gear housing 104 includes an auxiliary handle attachable part 140 to which the auxiliary handle 10 is detachably attached. As shown in FIG. 17 to FIG. 20, the gear housing 104 is mainly provided the auxiliary handle attachable part 140, a tool holder holding part 145, a housing engaging projection 147 and a switching lever holding part 149. The gear housing 104 is made of aluminum. However, the gear housing 104 may be made of other metallic material.

The auxiliary handle attachable part 140 is mainly provided with an auxiliary handle engaging groove 141, a flange 142 and the rotation preventing part 143. The first clamp member 21 and the second clamp member 31 of the auxiliary handle 10 engage with the auxiliary handle engaging groove 141, respectively. The flange 142 serves as a side wall of the auxiliary handle engaging groove 141, and thereby the flange 142 contacts with the first clamp member 21 and the second clamp member 31 engaged with the engaging groove 141. Thus, forward (toward tool bit 135) movement of the auxiliary handle 10 attached to the auxiliary handle attachable part 140 with respect to the screw driver 100 is prevented. That is, the flange 142 is provided to serve as a stopper which prevents the auxiliary handle 10 from moving in the longitudinal direction of the tool bit 135 (lateral direction of FIG. 10).

Figure 20:
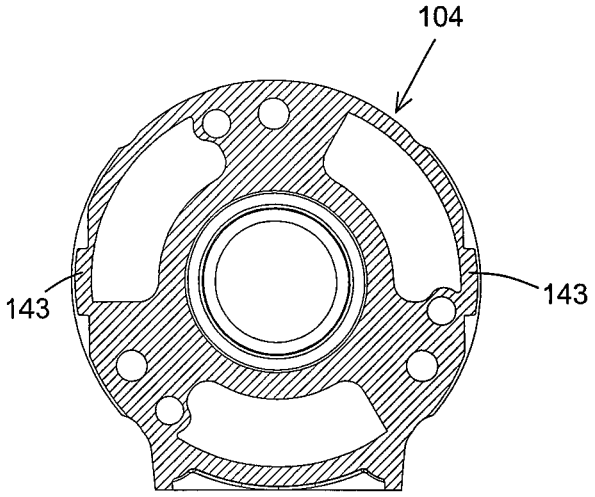
FIG. 20 shows a cross sectional view taken along the XX-XX line in FIG. 18.

As shown in FIG. 20, the rotation preventing part 143 is provided by a projection which is formed within the auxiliary handle engaging groove 141. The rotation preventing part 143 is provided on two parts respectively in a circumference direction of the gear housing 104. Namely, the two rotation preventing parts are provided to be opposed to each other with respect to the center of the gear housing 104. Each rotation preventing parts 143 is engageable with the engagement recess 24 of the first clamp member 21 of the auxiliary handle 10. Thus, as shown in FIG. 2, the engagement recess 24 of the auxiliary handle 10 mounted on the auxiliary handle attachable part 140 engages with one of the rotation preventing parts 143. Accordingly, (i) a first attaching aspect in which the auxiliary handle 10 is attached to the auxiliary handle attachable part 140 such that the grip 50 is located in the right housing 103*a* side as illustrated in FIG. 1, and (ii) a second attaching aspect in which the auxiliary handle 10 is attached to the auxiliary handle attachable part 140 such that the grip is located in the left housing 103*b* side contrary to the first attaching aspect illustrated in FIG. 1 is selected by a user according to an operation aspect of the screw driver 100. In both attaching aspect, the auxiliary handle 10 attached to the auxiliary handle attachable part 140 is prevented from rotating in the circumference direction of the screw driver 100 (gear housing 104) by an engagement between the engagement recess 24 and one of the rotation preventing parts 143. The auxiliary handle attachable part 140 is one example which corresponds to "an auxiliary handle attachable part" of this disclosure.

As shown in FIG. 17 to FIG. 20, the tool holder holding part 145 is formed cylindrically as a part of the gear housing 104. Further, as shown in FIG. 10, the tool holder holding part 145 holds the tool holder 130. When the trigger 107*a* is pulled (manipulated), the brushless motor 110 is turned ON and drives the tool holder 130 via the driving mechanism 120. Accordingly, the tool bit 135 is rotationally driven around the longitudinal direction of the tool bit 135 (lateral direction of FIG. 10) and thereby a screw operation is performed. An axis D illustrated in FIG. 10 is a driving axis of the tool bit 135. The tool bit 135 is one example which corresponds to "a tool bit" of this disclosure.

Figure 19:
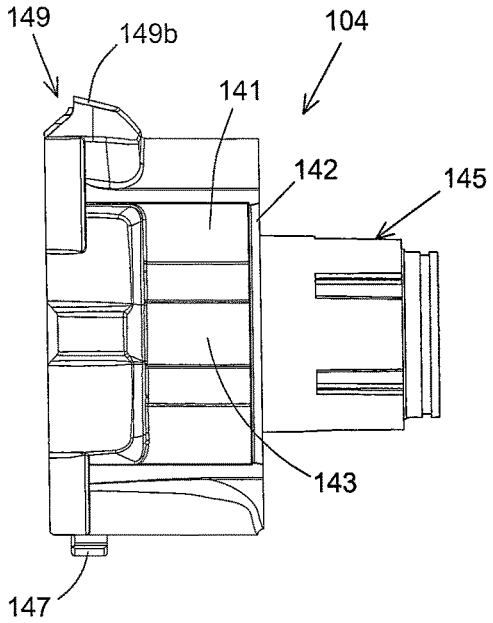
FIG. 19 shows a side view of the gear housing.

Further, as shown in FIG. 19, the housing engaging projection 147 is formed on a lower end region of the gear housing 104. The housing engaging projection 147 is formed on two parts respectively which correspond to the right housing 103*a* and the left housing 103*b*. Each housing engaging projection 147 is formed so as to extend outwardly from a center side of the screw driver 100 in a right-left direction of the screw driver 100. Each housing engaging projection 147 engages with the light holding parts 109*a*, 109*b* of the right housing 103*a* and the left housing 103*b* shown in FIG. 12 and FIG. 14, respectively. Thus, the light holding parts 109*a*, 109*b* which are respectively formed as a cantilever are stably held and supported by the gear housing 104.

Figure 21:
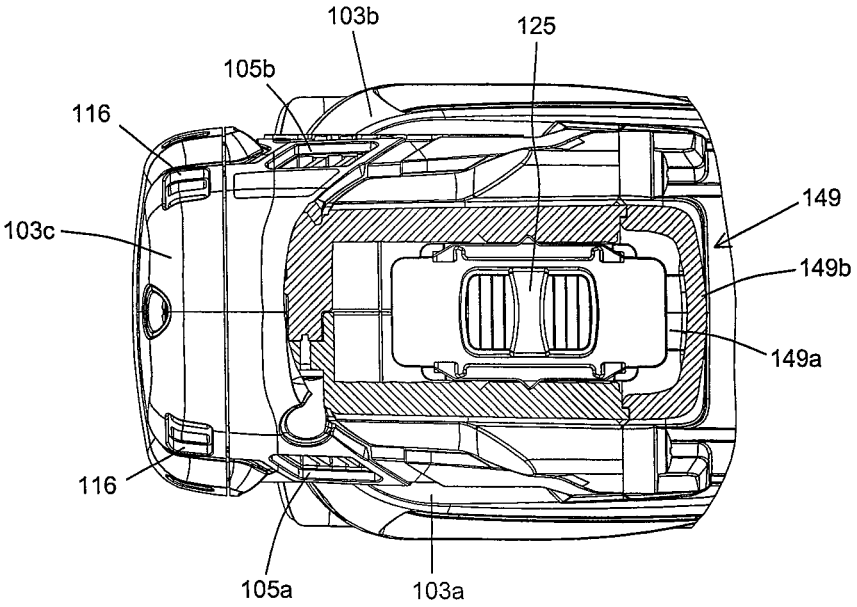
FIG. 21 shows a cross sectional view taken along the XXI-XXI line in FIG. 10.

Further, as shown in FIG. 10 and FIG. 17 to FIG. 19, the switching lever holding part 149 is formed on an upper end region of the gear housing 104. Specifically, as shown in FIG. 21, the switching lever 125 is provided on the main housing 103 and the gear housing 104 such that the switching lever 125 is slidable in the front-rear direction of the screw driver 100. The switching lever 125 switches the two planetary gear mechanisms which are used to transmit the torque of the brushless motor 110 among the three planetary gear mechanisms. The switching lever holding part 149 is provided with a guide part 149*a* and a cover part 149*b*. The switching lever 125 is arranged on the planar guide part 149*a* which guide the moving (sliding) switching lever 125. The cover part 149*b* is arranged on the guide part 149*a*, thereby the switching lever 125 is arranged between the guide part 149*a* and the cover part 149*b*. The cover part 149*b* is made of aluminum, however the cover part 149*b* may be made of other metallic material such as metal, magnesium and so on. The cover part 149*b* covers and protects the switching lever 125 from an external force.

According to this embodiment described above, when the auxiliary handle 10 is attached to the screw driver 100, the first clamp member 21 and the second clamp member 31 are simultaneously moved to be close to each other by rotation of the operation rod 40. Further, the first clamp member 21 and the second clamp member 31 are relatively moved against the operation rod 40, respectively. In other words, each of the first clamp member 21 and the second clamp member 31 is moved in parallel with the longitudinal direction of the operation rod 40. Accordingly, a change amount of the distance between the first clamp member 21 and the second clamp member 31 with respect to the one rotation of the operation rod 40 is increased. Thus, the auxiliary handle 10 is quickly attached to and detached from the screw driver 100.

Further, according to this embodiment, the center angle of the arc shape which is defined by the first engagement part 22 and the second engagement 32 exceeds 180 degrees. Thus, the first clamp member 21 and the second clamp member 31 are prevented from being released from the gear housing 104 by the shape of the first clamp member 21 and the second clamp member 31. As a result, the auxiliary handle 10 is stably attached to the gear housing 104 by both of the clamping force and the arc shape of the first clamp member 21 and the second clamp member 31.

Further, according to this embodiment, a relative rotation around the longitudinal direction of the operation rod 40 between the first clamp member 21 and the second clamp member 31 is prevented by the pin 36 and the pin sliding part 25. Thus, each movement of the first clamp member 21 and the second clamp member 31 to be close to each other by the rotation of the operation rod 40 is efficiently performed. Accordingly, attaching operation and detaching operation of the auxiliary handle 10 with respect to the screw driver 100 are rationally performed.

Further, according to this embodiment, the pin sliding part 25 and the pin 26 as a relative rotation preventing mechanism are arranged on side surfaces of the first clamp member 21 and the second clamp member 31, respectively. In case that the relative rotation preventing mechanism is arranged on a top part (upper part) of the first clamp member and the second clamp member, a height of the auxiliary handle is to be higher and the attached auxiliary handle to the screw driver may cause interference during an operation against a workpiece. However, in this disclosure, the relative rotation preventing mechanism is arranged on the side surfaces of the first clamp member 21 and the second clamp member 31. Therefore, a height of the auxiliary handle is to be shorter compared with the above-described arrangement. Accordingly, an operation of the screw driver 100 to which the auxiliary handle 10 is attached is rationally and smoothly performed without interference of the relative rotation preventing mechanism.

Further, according to this embodiment, a diameter of the first male thread part 45 differs from a diameter of the second female thread part 46. Thus, the first male thread part 45 and the second female thread part 46 are able to be formed on a singular member. In this respect, the first male thread part 45 and the second female thread part 46 are rationally provided on the outer surface and the inner surface of the screw member 42, respectively. Further, the first male thread part 45 and the second female thread part 46 are arranged so as to overlap to each other in the longitudinal direction of the operation rod 40. Thus, a length of the auxiliary handle 10 in the longitudinal direction of the operation rod 40 is shortened.

In the embodiment described above, the thread parts are formed on the outer surface and the inner surface of the screw member 42 formed cylindrically, however it is not limited to this. For example, the screw member may be formed as a stepped member which includes a large diameter part and a small diameter part having male thread parts respectively. In such a case, the first clamp member 21 and the second clamp member 31 may have female thread parts which correspond to the male thread parts formed on the large and small diameter parts, respectively.

Further, in the embodiment described above, the auxiliary handle 10 has the first clamp member 21 and the second clamp member, however it is not limited to this. For example, the auxiliary handle 10 may have more than three clamp members. In such a case, the more than three clamp members may be arranged on the same circumference and moved in a radial direction of the circle by an operation of a singular operating member such like the operation rod 40. Thereby, the more than three clamp members are simultaneously moved to be close or to be distant to each other. Accordingly, the auxiliary handle 10 is attached to the screw driver 100 (gear housing 104) by a clamping of the more than three clamp members. In such a case, plurality of operating members may be provided corresponding to each clamp member.

Further, in the embodiment described above, the screw driver 100 is utilized as one example of a power tool, however it is not limited to this. For example, an electrical hammer, a hammer drill or a multi tool like that may be utilized as a power tool to which the auxiliary handle 10 is attached.

Having regard to an aspect of this disclosure, following features are provided. Each feature may be utilized independently or in conjunction with other feature (s) or claimed invention(s).

(Feature 1)

The first clamp member and the second clamp member are respectively moved at the same time to be distant from each other by an detaching operation of the operation member operated by a user, and the first clamp member and the second clamp member release the clamp of the main body of the power tool, and the auxiliary handle is detached from the main body.

(Feature 2)

A power tool which drives a tool bit having its axis and performs a predetermined operation, comprising, an auxiliary handle attachable part to which an auxiliary handle is attached, and a stopper which is formed adjacent to the auxiliary handle attachable part with respect to the axial direction of the tool bit, wherein the stopper contacts with at least one of a first clamp member and a second clamp member of the auxiliary handle and prevents the auxiliary handle from moving in the axial direction of the tool bit with respect to the auxiliary handle attachable part.

The correspondence relationships between components of the embodiment and claimed inventions are as follows. The embodiment describes one example of a mode for carrying out the claimed inventions. However the claimed inventions are not limited to the configuration of the embodiment.

The auxiliary handle 10 corresponds to "an auxiliary handle" of the invention.

The first clamp member 21 corresponds to "a first clamp member" of the invention.

The first engagement part 22 corresponds to "a first arm" of the invention.

The second clamp member 31 corresponds to "a second clamp member" of the invention.

The second engagement part 32 corresponds to "a second arm" of the invention.

The first male thread part 45 corresponds to "a first screw part" of the invention.

The second female thread part 46 corresponds to "a second screw part" of the invention.

The first female thread part 23 corresponds to "a third screw part" of the invention.

The second male thread part 35 corresponds to "a fourth screw part" of the invention.

The operation rod 40 corresponds to "an operating member" of the invention.

The screw member 42 corresponds to "a clamp member holding part" of the invention.

The grip 50 corresponds to "a grip portion" of the invention.

The pin sliding part 25 corresponds to "a relative rotation preventing mechanism" of the invention.

The pin sliding part 25 corresponds to "a recess" of the invention.

The pin 36 corresponds to "a relative rotation preventing mechanism" of the invention.

The pin 36 corresponds to "a projection" of the invention.

The engagement recess 24 corresponds to "a handle side engagement part" of the invention.

The engagement recess 24 corresponds to "a handle side recess" of the invention.

The rotation preventing part 143 corresponds to "a main body side engagement part" of the invention.

The rotation preventing part 143 corresponds to "a main body side projection" of the invention.

The screw driver 100 corresponds to "a power tool" of the invention.

The auxiliary handle attachable part 140 corresponds to "an auxiliary handle attachable part" of the invention.

The tool bit 135 corresponds to "a tool bit" of the invention.

DESCRIPTION OF NUMERALS

10 auxiliary handle
20 holding mechanism
21 first clamp member
22 first engagement part
22*a* rod engaging hole
23 first female thread part
24 engagement recess
25 pin sliding part
26 stopping pole attached part
27 bolt
28 nut
29 stopping pole engaging hole
31 second clamp member
32 second engagement part
32*a* bolt engaging hole
33 rod engaging bolt
34 circular stopper
35 second male thread part
36 pin
40 operating rod
41 rod member
42 screw member
43 connecting part
44 operation screw part
45 first male thread part
46 second female thread part
50 grip
50*a* flange
100 screw driver
101 main body
103 main housing
103*a* right housing
103*b* left housing
103*c* rear cover
104 gear housing

105*a* air inlet
105*b* air inlet
106*a* boss hole
106*b* boss hole
107 handle
107*a* trigger
108 battery attachable part
109*a* light holding part
109*b* light holding part
110 brushless motor
116 air outlet
117 screw hole
118 screw
120 driving mechanism
125 switching lever
130 tool holder
135 tool bit
140 auxiliary handle attachable part
141 auxiliary handle engaging groove
142 flange
143 rotation preventing part
145 tool holder holding part
147 housing engaging projection
149 switching lever holding part
180 LED
190 battery

The invention claimed is:

1. An auxiliary handle which is detachably attached to a main body of a power tool having a main handle, the auxiliary handle comprising:

a grip portion which is configured to be held by a user, a first clamp member having a first clamp part, a second clamp member having a second clamp part, and a singular operation member which is configured to be operated by the user and configured to move the first clamp member and the second clamp member toward each other, wherein the first clamp member and the second clamp member are respectively configured to move at the same time to be close to each other by an attaching operation of the operation member configured to be operated by the user, and the first clamp part and the second clamp part clamp the main body of the power tool, and the auxiliary handle is attached to the main body by the first clamp member and the second clamp member, wherein the operation member is formed as an elongate member, and a clamp member holding part which holds the first clamp member and the second clamp member is provided on one end of the operation member, and the grip portion is provided on another end of the operation member, wherein the clamp member holding part includes a first screw part on which a left screw thread is formed and a second screw part on which a right screw thread is formed, the first screw part is configured to mesh with the first clamp member, the second screw part is configured to mesh with the second clamp member, wherein the first clamp member and the second clamp member are respectively configured to move at the same time to be close to each other by a rotating operation of the operation member such that the first clamp part and the second clamp part clamp the main body of the power tool.

2. The auxiliary handle according to claim 1, wherein the first clamp member having a third screw part configured to mesh with the first screw part, the second clamp member having a fourth screw part configured to mesh with the second screw part, and wherein the first screw part and the third screw part mesh with each other, while the second screw part and the fourth screw part mesh with each other at the same time by rotation of the operation member around its axis, so that the first clamp member and the second clamp member are configured to move simultaneously to be close to each other in the axial direction of the operation member, and the first clamp part and the second clamp part clamp the main body.

3. The auxiliary handle according to claim 2, wherein the clamp member holding part extends in the axial direction of the operation member, and the first clamp member has a first arm which extends in a cross direction crossing the axial direction of the operation member, the first arm having the first clamp part, and the second clamp member has a second arm which extends in the cross direction, the second arm having the second clamp part, and wherein the first clamp member is arranged closer to the grip portion of the operation member than the second clamp member in the axial direction of the operation member.

4. The auxiliary handle according to claim 3, wherein an auxiliary handle attachable part to which the auxiliary handle is attached is formed on the main body of the power tool, the auxiliary handle attachable part having a circular section, and wherein the first clamp part has a first arc engageable with the auxiliary handle attachable part, and the second clamp part has a second arc engageable with the auxiliary handle attachable part, in a state that the auxiliary handle is attached to the auxiliary handle attachable part, the first arc and the second arc are configured to form a predetermined arc whose a center angle exceeds 180 degrees.

5. The auxiliary handle according to claim 2, further comprising a relative rotation preventing mechanism which prevents a relative rotation of the first clamp member against the second clamp member around an axis of the clamp member holding part.

6. The auxiliary handle according to claim 5, wherein the relative rotation preventing mechanism comprises a projection which is formed on one member between the first clamp member and the second clamp member and a recess which is formed on another member between the first clamp member and the second clamp member, the projection and the recess extending in the axial direction of the clamp member holding part and being engageable with each other, in a state that the projection and the recess are engaged with each other, the first clamp member and the second clamp member are allowed to relatively move to each other in the axial direction of the clamp member holding part.

7. The auxiliary handle according to claim 5, wherein the relative rotation preventing mechanism is arranged on each side part of the first clamp member and the second clamp member.

8. The auxiliary handle according to claim 2, wherein a screw diameter of the first screw part is larger than a screw diameter of the second screw part.

9. The auxiliary handle according to claim 8, wherein the clamp member holding part is formed cylindrically, and the first screw part is provided by a male thread which is formed on an outer surface of the clamp member holding part, and the second screw part is provided by a female thread which is formed on an inner surface of the clamp member holding part, and wherein the first screw part and the second screw part are provided so as to overlap to each other in the axial direction of the clamp member holding part.

10. The auxiliary handle according to claim 1, wherein one of the first clamp member and the second clamp member has a handle side engagement part engageable with a main body side engagement part formed on the main body, in a state that the auxiliary handle is attached to the main body of the power tool, the handle side engagement part engages with the main body side engagement part and the auxiliary handle is prevented from moving with respect to the main body by an engagement of the handle side engagement part and the main body side engagement part.

11. A power tool having the auxiliary handle according to claim 10, configured to drive a tool bit having its axis and perform a predetermined operation, the power tool comprising a main body which has an auxiliary handle attachable part to which the auxiliary handle is detachably attached, wherein the auxiliary handle attachable part is formed cylindrically and is arranged coaxially with the axis of the tool bit, and wherein the main body side engagement part is provided by a plurality of main body side projections each of which is arranged at each part on the auxiliary handle attachable part in a circumference direction of the auxiliary handle attachable part, and wherein the handle side engagement part is provided by a handle side recess which is formed on one of the first clamp member and the second clamp member, and in a state that the auxiliary handle is attached to the auxiliary handle attachable part, the handle side recess is selectively engaged with one of the main body side projections and the auxiliary handle is prevented from rotating around the axis of the tool bit with respect to the main body by an engagement of the handle side recess and the main body side projection.

12. A power tool having the auxiliary handle according to claim 1, the power tool configured to drive a tool bit having its axis and perform a predetermined operation, the power tool comprising:

a main body which has an auxiliary handle attachable part to which the auxiliary handle is detachably attached, and a main handle which is connected to the main body.

13. The power tool according to claim 12, wherein the main handle has a main grip which extends in a cross direction crossing an axial direction of the tool bit, and wherein the auxiliary handle attachable part is configured such that the grip portion of the auxiliary handle is attached to the auxiliary handle attachable part in such a manner that the grip portion of the auxiliary handle extends in a direction crossing both of the axial direction of the tool bit and the cross direction.

14. An auxiliary handle which is detachably attached to a main body of a power tool having a main handle, the auxiliary handle comprising:

a grip portion which is configured to be held by a user, a first clamp member having a first clamp part, a second clamp member having a second clamp part, and a singular operation member which is configured to be operated by the user and configured to move the first clamp member and the second clamp member toward each other, wherein the first clamp member and the second clamp member are respectively configured to move at the same time to be close to each other by an attaching operation of the operation member configured to be operated by the user, and the first clamp part and the second clamp part clamp the main body of the power tool, and the auxiliary handle is attached to the main body by the first clamp member and the second clamp member, wherein a longitudinal axis of the grip portion is in alignment with a longitudinal axis of the operation member, the operation member being arranged between the grip portion and the first clamping member, and the grip portion, the operation member, the first clamping member and second clamping member are arranged in order along a direction parallel with the longitudinal axis of the operation member.

15. The auxiliary handle according to claim 14, wherein when the first clamp member and the second clamp are clamped to the main body of the power tool, each of a longitudinal axis of the grip portion and a longitudinal axis of the operation member intersect with a longitudinal axis of the main handle of the main body.

16. An auxiliary handle which is detachably attached to a main body of a power tool having a main handle, the auxiliary handle comprising:

a grip portion which is configured to be held by a user, a first clamp member having a first clamp part, a second clamp member having a second clamp part, and a singular operation member which is configured to be operated by the user and configured to move the first clamp member and the second clamp member toward each other, wherein the first clamp member and the second clamp member are respectively configured to move at the same time to be close to each other by an attaching operation of the operation member configured to be operated by the user, and the first clamp part and the second clamp part clamp the main body of the power tool, and the auxiliary handle is attached to the main body by the first clamp member and the second clamp member, wherein each of the first clamp member and the second clamp member includes a proximal end close to the grip portion and a free distal end that is further away from the grip portion, and wherein the singular operation member is configured to move the distal end of the first clamp member and the distal end of the second clamp member toward each other.

* * * * *